United States Patent [19]

Tokunaga

[11] Patent Number: 5,000,780

[45] Date of Patent: Mar. 19, 1991

[54] FRAGRANCE EMITTING METALS

[75] Inventor: Shigeo Tokunaga, Tokai, Japan

[73] Assignee: Daido Tokushuko Kabushiki Kaisha, Nagoya, Japan

[21] Appl. No.: 207,583

[22] Filed: Jun. 16, 1988

[51] Int. Cl.[5] ..... B22F 9/00

[52] U.S. Cl. ..... 75/246; 75/228; 419/26; 419/27; 419/39; 419/58; 419/60

[58] Field of Search ..... 75/228, 246; 428/550, 428/28; 63/DIG. 2; 419/26, 27, 39, 58, 60

[56] References Cited

U.S. PATENT DOCUMENTS 4,293,602 4/1981 Coffey et al. ..... 428/28

FOREIGN PATENT DOCUMENTS 2052434 4/1972 Fed. Rep. of Germany .

*Primary Examiner*—Stephen J. Lechert, Jr.
*Assistant Examiner*—N. Bhat
*Attorney, Agent, or Firm*—Schwartz & Weinrieb

[57] ABSTRACT

Disclosed is a fragrance emitting metal composed of a sintered metallic body prepared by press-molding a metal powder for sintering within a mold having a required shape, followed by sintering of the resulting molded product at a required temperature, characterized by the constitution wherein the molding pressure is controlled so that the resulting sintered product may have a porosity which permits infiltration of a liquid perfumery therethrough; and the surface of the sintered metallic body is partially polished so as to reduce the porosity of the polished surface, thereby improving the property of sustaining the diffusion of the fragrance from the liquid perfumery infiltrated therethrough and also to impart gloss and luster thereto.

10 Claims, 2 Drawing Sheets

FRAGRANCE EMITTING METALS

FIELD OF THE INVENTION

This invention relates to a fragrance emitting metal, and more particularly to a fragrance emitting metal comprising a sintered metallic body which exhibits the improved property of sustaining the diffusion of the fragrance over a long period of time when it is impregnated with a liquid aromatic material, and which is particularly suitable for use with clothing or apparel accessories.

BACKGROUND OF THE INVENTION

Liquid aromatic materials (perfumeries) such as, for example, perfumes, eau de Colognes, and the like are loved and widely used particularly by women, by applying the same in small quantities to specific parts of the body whereby the same serve as a sort of social etiquette. Such liquid perfumeries are either applied directly to one's body or clothing. In the former case, if a user has constitutional tendencies toward allergies or if undesirable components are included within the perfumery composition, eruptions, rashes, or the like may sometimes be caused upon the skin of the user. On the other hand, it is generally known that in the latter case, if the user applies a perfumery to her clothing, the site of the application of the perfumery may become discolored or stained. Furthermore, some other disadvantages can be pointed out or noted in that, regardless of the site of the application of the perfumery either to the body or to the clothing, an overpowering scent is liable to be emitted if the perfumery is used in an excessive amount, and in addition the aromatic components are volatilized immediately, or in other words, the diffusion of the fragrance cannot be sustained over a prolonged period of time, depending upon the conditions under which the perfumery is used.

In this connection, Japanese Patent No. 177040 (Japanese Patent Publication No. 621/1948) discloses a metallic body prepared by kneading a particulate metal or alloy of any kind with a binder so as to impart plasticity to the former, molding the resulting composition into a required shape, and drying the molded product, followed by sintering at an appropriate temperature; or alternatively, by impregnating a porous metallic body obtained according to any other appropriate sintering methods with a solution of a fragrance emissive material or a liquid fragrance emissive material. Accordingly, when the porous metallic body mentioned above is processed into the form of an accessory such as, for example, a pendant, brooch, earrings, and the like and impregnated with a liquid perfumery, even those who have an allergic constitution may not suffer such eruption or rash as mentioned above since the liquid perfumery may not be brought into direct contact with their body skin, and discoloration or staining of the clothing may not be generated, since the perfumery is likewise not applied directly to the clothing.

However, the accessories made from the porous metallic body serving as the base material have pores all over the entire surface area thereof. Accordingly, if such metallic body is impregnated with a liquid perfumery, the aromatic components thereof may diffuse out from the entire surface of the metallic body, resulting in the difficulty of sustaining the diffusion the fragrance over a prolonged period of time. Also, in addition to the diffusion of the aromatic components from the entire surface of the metallic body as mentioned above, the problem of the overpowering scent likely to be emitted still remains unsolved.

OBJECT OF THE INVENTION

This invention has been proposed in view of the foregoing disadvantages inherent in the prior art and for the purpose of overcoming them, and is directed toward providing a fragrance emitting metal which can be suitably used when formed into clothing or apparel accessories so as to sustain the diffusion of the aromatic component over a prolonged period of time and which does not emit an excessive or overpowering scent, when the porous metallic body is impregnated with a liquid perfumery.

SUMMARY OF THE INVENTION

For the purpose of overcoming the problems mentioned above and for suitably achieving the intended object, this invention provides a fragrance emitting metal composed of a sintered metallic body prepared by press-molding a metal powder for sintering within a mold having a required shape, followed by sintering of the resulting molded product at a required temperature, characterized by the constitution wherein the molding pressure is controlled so that the resulting sintered product may have a porosity which permits infiltration of a liquid perfumery therethrough and the surface of the above sintered metallic body is partially polished so as to reduce the porosity of the polished surface, thereby improving the property of sustaining the diffusion of the fragrance from the liquid perfumery infiltrated therethrough, over an extended length of time, as well as, imparting gloss and luster to the sintered metallic body.

BRIEF DESCRIPTION OF THE DRAWINGS

The drawings show an embodiment of the fragrance emitting metal fabricated according to this invention and formed into an apparel accessory, the objects, features, and attendant advantages of which will become better understood from the following detailed description when considered in connection with the accompanying drawings, in which like reference characters designate like or corresponding parts throughout the several views, and wherein.

DETAILED DESCRIPTION OF THE INVENTION

Next, the fragrance emitting metal fabricated according to this invention will be explained below by way of an embodiment wherein the metal has been fabricated into the form of an apparel accessory, and with reference being made to the attached drawings.

Figure 3:
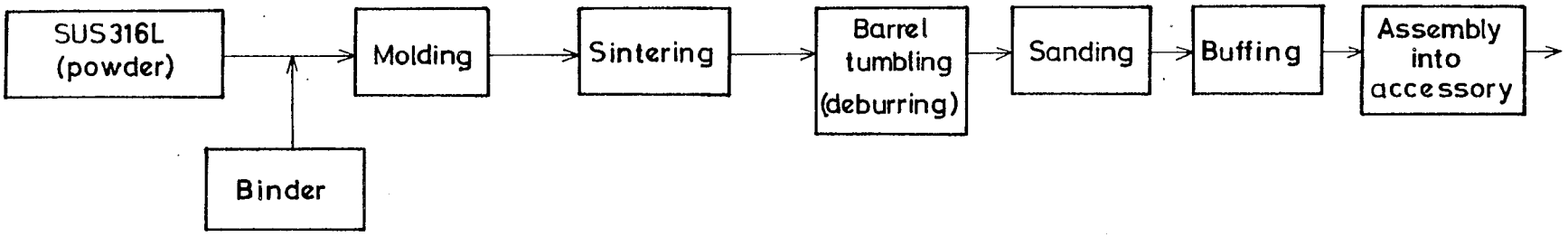
FIG. 3 is a flow chart showing an exemplary process for preparing a sintered metallic body which is used as a base material for the fragrance emitting metal fabricated according to this invention.

The fragrance emitting metal according to this embodiment comprises a sintered metallic body serving as a base material and prepared by pressing a metal powder for sintering within a mold having a required shape, followed by sintering at a required, temperature, the device being used as a body for apparel accessories such as, for example, a pendant, brooch, earrings, bracelet, hat pin, or the like. For example, as shown in FIG. 3, a metal powder comprising an austenite stainless steel SUS 316L (Japanese Industrial Standard) having excellent anti-corrosion and non-magnetic properties, and a binder such as, for example, zinc stearate are kneaded so as to form a mixture, and the mixture is introduced into a mold, followed by pressing the mixture at a required pressure by use of a 15- to 50-ton press, so as to provide a molded body of a required shape.

It should be noted that the pressure to be applied to the mixture mentioned above contained within the mold is controlled so that the resulting sintered metallic body may have an optimum porosity so as to permit infiltration of a liquid perfumery therethrough, the pressure being for example, approximately 4 to 5 ton/cm$^2$, whereby the resulting press-molded product is designed so as to have a density of 6.2 to 6.6, preferably 6.4, and a porosity of not less than 10%. In this connection, an ordinary sintered metallic body is designed to have a much higher density level for enhancing the strength of the material, and thus it is inadequate for achieving the requisite infiltration of the liquid perfumery therethrough. On the other hand, if the density is lower than the lower limit as mentioned above and the porosity is increased, infiltration of a liquid perfumery therethrough may be possible, but brittleness may be increased so as to readily form cracks, and the resulting product cannot be employed for practical purposes.

Figure 1:
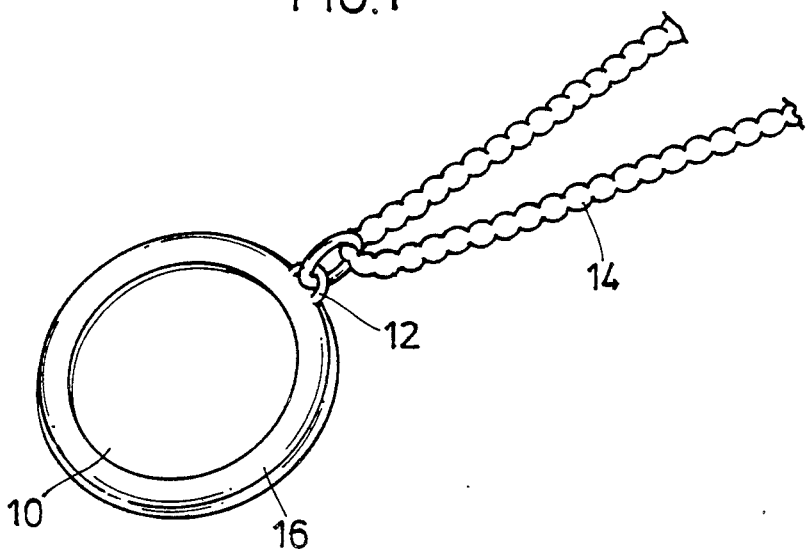
FIG. 1 is a perspective view of a completed form of a pendant wherein a round fragrance emitting metallic body of the pendant is fitted within a frame.

The mold to be used for confining the above mixture is formed so as to have a cavity of various contours such as, for example, a round or polygonal configuration, and also flat inner wall surfaces for favorably practicing this invention. By pressing the above mixture within a mold having such a configuration, a flat body 10 for an apparel accessory, such as, for example, a pendant having a round contour as its final shape is formed as shown in FIG. 1. Also, by allowing the wall of the mold to have a required convex/concave pattern, in addition to various contours given to the cavity thereof, and by press-molding the above mixture within such mold, a body 10 for an accessory having a required contour with a relief of various patterns can be formed.

The resulting press-molded product formed within the mold mentioned above is then sintered within a vacuum sintering furnace or a cracked ammonia gas furnace by heating the same at a temperature of 1,000° to 1,150° C. for about one hour to effect sintering. Subsequently, the sintered product is removed from the furnace and gradually cooled through normal heat dissipation at room temperature so as to provide a sintered metallic body having a required contour with a convex/concave pattern, as necessary. While the sintered metallic body obtained has been designed so as to have an optimum density of 6.2 to 6.6 and a porosity of not less than 10%, which are suitable for achieving the infiltration of the liquid perfumery therethrough, it still has a rough surface and burrs as well. Accordingly, the sintered metallic body is subjected to barrel tumbling. Since, in accordance with this process, the surface of the sintered metallic body which has been polished somewhat by means of the barrel tumbling process, but yet has no substantial metallic luster, so as to exhibit, in fact, a so-called matte finish, the density and the porosity achieved in accordance with the preceding press-molding process has not been impaired or altered.

The sintered metallic body obtained above can be impregnated with a liquid perfumery by applying drops of the liquid perfumery to the porous portion of the sintered metallic body. However, the sintered metallic body according to this embodiment is in fact subsequently polished so that the porosity of the surface thereof may be partially reduced so as to prevent diffusion of the liquid perfumery impregnated within the portion of reduced porosity over an extended period of time and in addition gloss and luster may be imparted thereto.

Figure 2:
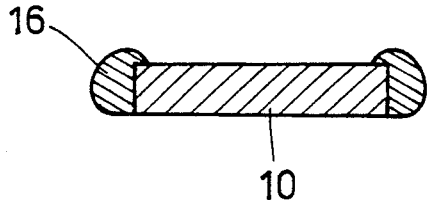
FIG. 2 shows a cross-section of a round fragrance emitting metallic body and a round frame for mounting the former therein through means of a press-fitting or adhesion operation.

Namely, the pendant shown in FIG. 1 consists of a round frame 16, which can be attached to a neck chain 14 through means of a round ring 12, and a round body 10 which is fitted within the frame 16. The round body 10 comprises a flat sintered metallic body as shown in FIG. 2, and the front surface (the surface which generally faces outward when placed upon a human body as an accessory, that is the most noticeable face) is subjected to sanding by means of a sander employing, for example, sand paper of fine grain size, and the like. The porous portion of the surface of the sintered metallic body being polished is ground into a microstructure as a result of such sanding, so that the porosity at that portion is notably reduced. Although, by means of such polishing with sand paper and the like, better luster can be imparted to the surface being polished than upon the matte finished surface achieved by means of the barrel tumbling process, further improved gloss and luster characterized by means of a mirror finish which are essential for accessories can be imparted to the surface of the round body 10 by further application of buffing techniques to the surface being polished.

Thus, when the fragrance emitting metal which is designed to constitute the body of various accessories is actually used, a liquid perfumery such as, for example, a perfume, eau de Cologne, and the like depending upon one's preference is dropped onto the exposed surface of the body of the accessory comprising the porous portion which is only matte finished by means of the barrel tumbling process. Thus, impregnation of the body is achieved by infiltration of the liquid perfumery through means of the matte-finished porous portion, and one can enjoy the fragrance emitted from the perfumery merely by wearing the accessory to which the impregnated body is attached. In such instance, since the portion of the body of the accessory to which the gloss and luster of the mirror finish, which are essential factors for accessories, have been imparted by means of polishing the same with a sand paper and the like has a reduced amount of porosity as a result of the grinding of the porous surface, the diffusion of the fragrance of the perfumery from the portion of reduced porosity can be sustained and maintained for a prolonged period of time. In addition, if the fragrance emitting metal is impregnated with a relatively large amount of liquid perfumery, the aromatic components thereof may not be excessively emitted, so that it will not emit an overpowering scent to the atmosphere.

Moreover, the user need only the accessory having incorporated therein the fragrance emitting metal as a body of the accessory impregnated with a liquid perfumery, so that those who normally experience allergic reactions may not suffer any eruptions, rashes, and the like, and discoloration or staining of clothing is also not caused. Obviously, many modifications and variations of the present invention are possible in light of the above teachings. It is therefore to be understood that within the scope of the appended claims, the present invention may be practiced otherwise than as specifically described herein.

What is claimed is:

1. A fragrance emitting metal product, composed of a press-molded, sintered metallic body, prepared by means of a process comprising the steps of:

press-molding a metal powder within a mold having a predetermined configuration;

sintering said molded product at a temperature which is within the range of 1000°–1150° C.;

wherein the molding pressure is within the range of 4–5 ton/cm$^2$ so that the resulting sintered product has a porosity of at least 10% and a density which is within the range of 6.2–6.6 so as to permit infiltration of a liquid perfumery therethrough; and partially polishing the surface of said sintered metallic body so as to reduce said porosity of said polished surface so as to thereby improve the property of sustaining the diffusion of the fragrance from said liquid perfumery infiltrated therewithin and to also impart gloss and luster thereto.

2. The fragrance emitting metal according to claim 1, wherein:

said sintered metallic body is used as a body of an accessory selected from the group consisting of a pendant, brooch, earrings, bracelet, and hat pin.

3. The fragrance emitting metal according to claim 1, wherein the sintered metallic body which constitutes the body of the accessory is polished mainly on the front surface for reducing the porosity thereof.

4. The fragrance emitting metal according to claim 1, wherein a relief pattern comprising convex/concave portions is formed on the front surface and/or rear surface of the sintered metallic body constituting the body of the accessory, and the surfaces at the convex portions are polished to reduce the porosity thereof.

5. The fragrance emitting metal according to claim 1, wherein:

said metal powder comprises an austenite stainless steel.

6. The fragrance emitting metal as set forth in claim 1, wherein:

said molded product is sintered within a vacuum sintering furnace.

7. The fragrance emitting metal as set forth in claim 1, wherein:

said molded product is sintered within a cracked ammonia gas furnace.

8. The fragrance emitting metal as set forth in claim 1, wherein:

said polishing is performed by means of barrel tumbling.

9. The fragrance emitting metal as set forth in claim 1, wherein:

said polishing is performed by means of sanding.

10. The fragrance emitting metal as set forth in claim 1, wherein:

said polishing further comprises buffing.

* * * * *